US006662872B2

(12) United States Patent
Gutek et al.

(10) Patent No.: US 6,662,872 B2
(45) Date of Patent: Dec. 16, 2003

(54) COMBINED STEAM AND VAPOR EXTRACTION PROCESS (SAVEX) FOR IN SITU BITUMEN AND HEAVY OIL PRODUCTION

(75) Inventors: A. M. Harold Gutek, Calgary Alberta (CA); Brian Harschnitz, Calgary Alberta (CA); Ronald D. Myers, Calgary Alberta (CA); Tadahiro Okazawa, Calgary Alberta (CA)

(73) Assignee: ExxonMobil Upstream Research Company, Houston, TX (US)

( * ) Notice: Subject to any disclaimer, the term of this patent is extended or adjusted under 35 U.S.C. 154(b) by 38 days.

(21) Appl. No.: 10/045,293

(22) Filed: Nov. 7, 2001

(65) Prior Publication Data

US 2003/0000711 A1 Jan. 2, 2003

(51) Int. Cl.[7] ..... E21B 43/22; E21B 43/24

(52) U.S. Cl. ..... 166/272.4; 166/263; 166/270; 166/403

(58) Field of Search ..... 166/268, 270, 166/401, 402, 403, 272.1, 272.3, 272.4, 263, 305.1, 306

(56) References Cited

U.S. PATENT DOCUMENTS

| | | | | |
|---|---|---|---|---|
| 2,365,591 A | | 12/1944 | Ranney | 262/1 |
| 3,608,638 A | | 9/1971 | Terwilliger | 166/272 |
| 3,881,550 A | * | 5/1975 | Barry | 166/272.6 |
| 3,908,762 A | | 9/1975 | Redford | 166/263 |
| 3,960,214 A | | 6/1976 | Striegler et al. | 166/272 |
| 3,986,557 A | | 10/1976 | Striegler et al. | 166/272 |
| 4,004,636 A | | 1/1977 | Brown et al. | 166/272 |
| 4,007,785 A | | 2/1977 | Allen et al. | 166/263 |
| 4,020,901 A | | 5/1977 | Pisio et al. | 166/50 |

(List continued on next page.)

FOREIGN PATENT DOCUMENTS

| | | | |
|---|---|---|---|
| CA | 1015656 | 8/1977 | 166/31 |
| CA | 1059432 | 7/1979 | E21B/43/00 |
| CA | 1122115 | 4/1982 | E21B/43/28 |
| CA | 2108349 | 8/1996 | |
| CA | 2147079 | 10/1996 | E21B/43/16 |
| CA | 2304938 | 2/2001 | E21B/43/24 |
| CA | 2243105 | 11/2001 | E21B/43/22 |

OTHER PUBLICATIONS

Butler, R.M. and Mokrys, I.J., "A New Process (VAPEX) for Recovering Heavy Oils Using Hot Water and Hydrocarbon Vapour", JCPT, vol. 30, No. 1, pp. 97–106, Jan.–Feb. 1991.

Butler, R.M. and Mokrys, I.J., Recovery of Heavy Oils Using Vapourized Hydrocarbon Solvents: Further Developments of the VAPEX Process:, JCPT, vol. 32, No. 6, pp. 56–62, Jun. 1993.

(List continued on next page.)

*Primary Examiner*—David Bagnell
*Assistant Examiner*—Jennifer H Gay
(74) *Attorney, Agent, or Firm*—Gary P. Katz

(57) ABSTRACT

Steam is injected into the reservoir, heats the reservoir to mobilize and recover at least a fraction of reservoir hydrocarbons, forming a steam chamber in the reservoir. The steam is continuously injected into the reservoir to mobilize and recover reservoir hydrocarbons therefrom until at least one of (i) an upper surface of the chamber has progressed vertically to a position that is approximately 25 percent to 75 percent the distance from the bottom of the injection well to the top of the reservoir, and (ii) the recovery rate of the hydrocarbons is approximately 25 percent to 75 percent of the peak predicted recovery rate using steam-assisted gravity drainage. A viscosity-reducing hydrocarbon solvent is injected into the reservoir, the solvent being capable of existing in vapor form in the chamber and being just below the solvent's saturation pressure in the chamber, mobilizing and recovering additional hydrocarbons from the reservoir.

23 Claims, 2 Drawing Sheets

U.S. PATENT DOCUMENTS

| | | | | | |
|---|---|---|---|---|---|
| 4,026,358 | A | | 5/1977 | Allen | 166/261 |
| 4,034,812 | A | | 7/1977 | Widmyer | 166/303 |
| 4,037,658 | A | | 7/1977 | Anderson | 166/272 |
| 4,067,391 | A | | 1/1978 | Dewell | 166/303 |
| 4,085,803 | A | | 4/1978 | Butler | 166/303 |
| 4,099,568 | A | | 7/1978 | Allen | 166/269 |
| 4,109,720 | A | | 8/1978 | Allen et al. | 166/269 |
| 4,116,275 | A | | 9/1978 | Butler et al. | 166/303 |
| 4,127,170 | A | | 11/1978 | Redford | 166/252 |
| 4,160,481 | A | | 7/1979 | Turk et al. | 166/272 |
| 4,166,503 | A | | 9/1979 | Hall et al. | 166/263 |
| 4,257,650 | A | | 3/1981 | Allen | 299/2 |
| 4,262,745 | A | | 4/1981 | Stewart | 166/263 |
| 4,280,559 | A | | 7/1981 | Best | 166/303 |
| 4,293,035 | A | | 10/1981 | Fitch | 166/273 |
| 4,296,969 | A | | 10/1981 | Willman | 299/2 |
| 4,324,291 | A | | 4/1982 | Wong et al. | 166/252 |
| 4,327,805 | A | * | 5/1982 | Poston | 166/401 |
| 4,344,485 | A | | 8/1982 | Butler | 166/271 |
| 4,372,383 | A | | 2/1983 | Ames | 166/266 |
| 4,373,585 | A | | 2/1983 | Fitch et al. | 166/263 |
| 4,379,592 | A | | 4/1983 | Vakhnin et al. | 299/2 |
| 4,385,662 | A | | 5/1983 | Mullins et al. | 166/263 |
| 4,390,067 | A | | 6/1983 | Willman | 166/245 |
| 4,434,849 | A | | 3/1984 | Allen | 166/252 |
| 4,450,913 | A | | 5/1984 | Allen et al. | 166/303 |
| 4,460,044 | A | | 7/1984 | Porter | 166/252 |
| 4,463,988 | A | | 8/1984 | Bouck et al. | 299/2 |
| 4,466,485 | A | | 8/1984 | Shu | 166/272 |
| 4,498,537 | A | | 2/1985 | Cook | 166/257 |
| 4,501,326 | A | | 2/1985 | Edmunds | 166/272 |
| 4,510,997 | A | | 4/1985 | Fitch et al. | 166/263 |
| 4,511,000 | A | | 4/1985 | Mims | 166/303 |
| 4,513,819 | A | | 4/1985 | Islip et al. | 166/263 |
| 4,519,454 | A | | 5/1985 | McMillen | 166/303 |
| 4,535,845 | A | | 8/1985 | Brown et al. | 166/272 |
| 4,565,245 | A | | 1/1986 | Mims et al. | 166/50 |
| 4,577,691 | A | | 3/1986 | Huang et al. | 166/263 |
| 4,589,486 | A | | 5/1986 | Brown et al. | 166/252 |
| 4,598,770 | A | | 7/1986 | Shu et al. | 166/245 |
| 4,640,359 | A | | 2/1987 | Livesey et al. | 166/276 |
| 4,682,652 | A | | 7/1987 | Huang et al. | 166/263 |
| 4,697,642 | A | | 10/1987 | Vogel | 166/263 |
| 4,700,779 | A | | 10/1987 | Huang et al. | 166/263 |
| 4,706,751 | A | | 11/1987 | Gondouin | 166/272 |
| 4,753,293 | A | | 6/1988 | Bohn | 166/267 |
| 4,794,987 | A | | 1/1989 | Kokolis et al. | 166/274 |
| 4,818,370 | A | | 4/1989 | Gregoli et al. | 208/106 |
| 4,834,179 | A | | 5/1989 | Kokolis et al. | 166/268 |
| 4,844,158 | A | | 7/1989 | Jennings, Jr. | 166/267 |
| 4,850,429 | A | | 7/1989 | Mims et al. | 166/245 |
| 4,860,827 | A | * | 8/1989 | Lee et al. | 166/261 |
| 5,060,726 | A | | 10/1991 | Glandt et al. | 166/248 |
| 5,148,869 | A | | 9/1992 | Sanchez | 166/303 |
| 5,167,280 | A | | 12/1992 | Sanchez et al. | 166/267 |
| 5,215,146 | A | | 6/1993 | Sanchez | 166/263 |
| 5,215,149 | A | | 6/1993 | Lu | 166/303 |
| 5,244,041 | A | | 9/1993 | Renard et al. | 166/268 |
| 5,273,111 | A | | 12/1993 | Brannan et al. | 166/245 |
| 5,339,897 | A | | 8/1994 | Leaute | 166/245 |
| 5,407,009 | A | | 4/1995 | Butler et al. | 166/266 |
| 5,411,094 | A | | 5/1995 | Northrop | 166/303 |
| 5,413,175 | A | | 5/1995 | Edmunds | 166/252 |
| 5,417,283 | A | | 5/1995 | Ejiogu et al. | 166/272 |
| 5,456,315 | A | | 10/1995 | Kisman et al. | 166/245 |
| 5,503,226 | A | | 4/1996 | Wadleigh | 166/252.1 |
| 5,607,016 | A | | 3/1997 | Butler | 166/263 |
| 5,626,193 | A | | 5/1997 | Nzekwu et al. | 166/303 |
| 5,685,371 | A | | 11/1997 | Richardson et al. | 166/272 |
| 5,765,964 | A | * | 6/1998 | Calcote et al. | 166/272.1 |
| 5,771,973 | A | | 6/1998 | Jensen et al. | 166/303 |
| 5,803,171 | A | | 9/1998 | McCaffery et al. | 166/245 |
| 5,826,655 | A | | 10/1998 | Snow et al. | 166/272.3 |
| 5,860,475 | A | | 1/1999 | Ejiogu et al. | 166/245 |
| 5,899,274 | A | | 5/1999 | Frauenfeld et al. | 166/401 |
| 5,931,230 | A | | 8/1999 | Lesage et al. | 166/303 |
| 6,050,335 | A | | 4/2000 | Parsons | 166/272.3 |
| 6,119,776 | A | | 9/2000 | Graham et al. | 166/245 |
| 6,158,510 | A | | 12/2000 | Bacon et al. | 166/272.7 |
| 6,167,966 | B1 | | 1/2001 | Ayasse et al. | 166/268 |
| 6,186,232 | B1 | | 2/2001 | Isaacs et al. | 166/272.3 |
| 6,230,814 | B1 | | 5/2001 | Nasr et al. | 166/400 |
| 6,257,334 | B1 | | 7/2001 | Cyr et al. | 166/272.7 |
| 6,263,965 | B1 | | 7/2001 | Schmidt et al. | 166/272.3 |
| 6,305,472 | B2 | | 10/2001 | Richardson et al. | 166/305.1 |
| 6,318,464 | B1 | | 11/2001 | Mokrys | 166/252.01 |
| 2001/0018975 | A1 | | 9/2001 | Richardson et al. | 166/305.1 |

OTHER PUBLICATIONS

S.K. Das and Butler, R.M., "Effect of Asphaltene Deposition on the VAPEX Process: A Preliminary Investigation Using A Hele–Shaw Cell", JCPT, vol. 33, No. 6, pp. 39–45, Jun. 1994.

Das, S.K., "In Situ Recovery of Heavy Oil and Bitumen Using Vaporized Hydrocarbon Solvents", Dissertation for the Degree of Doctor of Philosophy, The University of Calgary, Mar. 1995, p. 129,132,133,219,220.

Palmgren, C. and Edmunds, N.; "High Temperature Naptha to Replace Steam in the SAGD Process", International Heavy Oil Symposium, Calgary, Alberta Canada, Jun. 19–21, 1995, SPE 30294.

Butler, R.M., "Thermal Recovery of Oil and Bitumen", GravDrain Inc., Calgary Alberta, Aug. 1997, p. 292, 300, 301.

Komery, D.P., Luhning, R.W., Pearce, J.V., Goo, W.K., "Pilot Testing of Post–Steam Birumen Recovery from Mature SAGD Wells in Canada", Seventh UNITAR International Conference, Beijing, China, Oct. 27–31, 1998.

S.K. Das and Butler, R.M., "Mechanism of the Vapor Extraction Process for Heavy Oil and Bitumen", Journal of Petroleum Science and Engineering 21, pp. 43–59, 1998.

Saltuklaroglu, M., Wright, G.N., Conrad, P.R., McIntyre, J.R., Manchester, G.T. "Mobil's SAGD Experience at Celtic Saskatchewan", CSPG and Petroleum Society Joint Convention, Calgary, Alberta Canada, Jun. 14–18, 1999.

Donnelly, J.K., "The Best Process for Cold Lake CSS Verses SAGD", CSPG and Petroleum Society Joint Convention, Calgary, Alberta Canada, Jun. 1999.

Luhning, R.W., Lugning, C.P., "The Vapex Process: Non–Thermal Recovery of Birumen and Heavy Oil for Improved Economics and Climate Change Advantage", CHOA Conference, Calgary, Alberta, Canada, Nov. 24, 1999.

Butler, R.M., Bharatha, S., Yee, C.–T., "Natural and Gas–lift in SAGD Production Wells", Journal of Canadian Petroleum Technology, vol. 39, No. 1, pp. 18–29, Jan. 2000.

Butler, R.M., Jiang, W., "Imrpvoed Recovery of Heavy Oil by Vapex with Widely Spaced Horizontal Injectors and Producers", JCPT, Vol, 39, No. 1, pp. 48–56, Jan. 2000.

Gupta, S., Gittins, S., Picherack, P.,"Insights into Some Key Issues with Solvent Aided Process", Petroleum Society—Canadian Institute of Mining, Metallurgy & Petroleum, Paper No. 2001–126, pp 1–23, Jun. 12–14, 2001.

Vogel, Jack V., "How Solvent Vapors Can Improve Steam Floods", World Oil, Nov. 1996.

Nasr, T.N., Kimber, K.D., Jha, K.N., "A Novel Scaled Physical Simulator for Horizontal Well Enhanced Oil Recovery", Petroleum Society of CIM and CANMET, Paper No. 5, pp 5–1 to 5–19, Oct. 7–9, 1991.

Cuthiell, D., McCarthy, C., Frauenfeld, T., Cameron, S., Kissel, G., "Investigation of the Vapex Process Using CT Scanning and Numerical Simulation", Petroleum Society—Canadian Institute of Mining, Metallurgy & Petroleum, Paper No. 2001–128, pp 1–17, Jun. 12–14 2001.

Nghiem, L.X., Kohse, B.F., Sammon, P.H., "Compositional Simulation of the Vapex Process", Petroleum Society—Canadian Institute of Mining, Metallurgy & Petroleum, Paper No. 2000–34, Jun. 4–8, 2000.

Doan, Q., Doan, L., Ali, S. M. Farouq, George, A.E., "Usefulness of Scaled Models in Heavy Oil Recovery Development by Steam and Horizontal Wells", 6th UNITAR International Conference, Houston Texas, pp 689–706, Feb. 12–17, 1995.

Das, S. K., Butler, R. M.,"Extraction of Heavy Oil and Bitumen Using Solvents at Reservoir Pressure", Petroleum Society of CIM, Paper No. 95–118, pp 1–15, Oct. 16–18 1995.

Butler, R.M., Mokrys, I.J., "A New Process (VAPEX) for Recovering Heavy Oils using Hot Water and Hydrocarbon Vapour", Petroleum Society of CIM/Society of Petroleum Engineers Paper No. CUM/SPE 90–133, pp 133–1–133–15, Jun. 10–13, 1990.

Jha, K.N., Butler, R.M., Lim, G.B., Oballa V., "Vapour Extraction (VAPEX) Process for Recovery of Heavy Oil and Bitumen", 6th UNITAR International Conference, Houston Texas, pp 759–774, Feb. 12–17, 1995.

Fair, A.E., McIntosh J.R., "Can In Situ Recovery Compete with Open Pit Mining in the Oil Sands", AOSTRA/Canadian Heavy Oil Association, pp 121–132, Jun. 10–12, 1992.

Chang, H.L., Ali S.M. Farouq, George, A.E., "Performance of Horizontal–Vertical Well Combinations for Steamflooding Bottom Water Formations", Petroleum Society of CIM/Society of Petroleum Engineers, Paper No. CIM/SPE 90–86, pp 86–1–86–16, Jun. 10–13, 1990.

Chang, H.L., Ali S.M. Farouq, George, A.E., "Steamflood Applications for Marginal Heavy Oil Reservoirs with Underlying Bottom Water", 5th Unitar International Conference on Heavy Crude and Tar Sands, pp 193–205, 1992.

Butler, R., Yee, C. T., "Progress in the In Situ Recovery of Heavy Oils and Bitumen", Petroleum Society—Canadian Institute of Mining, Metallurgy & Petroleum, Paper No. 2000–50, Jun. 4–8, 2000.

Jiang, Q., Butler, R.M., Yee C.T., "Steam and Gas Push (SAGP)—4; Recent Theoretical Developments and Laboratory Results Using Layered Models", Petroleum Society—Canadian Institute of Mining, Metallurgy & Petroleum, Paper No. 2000–51, Jun. 4–8, 2000.

Butler, R.M., "Application of SAGD, Related Processes Growing in Canada", Oil and Gas Journal, pp 74–78, May 14, 2001.

Minssieux, L., Bardon, C., Rouet, J., Groffe, P., "Effects of Asphaltene Deposition in Production Treatment and Prevention Tests", International Symposium on Colloid Chemistry in Oil Production, Nov. 26–29, 1995.

Butler, R.M., "SAGD Comes of Age", JCPT.

Butler, R.M., Yee, C.T., "An Experimental Study of Steam Condensation in the Presence of Non–condensable Gases in Porous Solids", AOSTRA Journal of Research, vol. 3, No. 1, pp 15–23, 1986.

Butler, R.M., "Steam and Gas Push (SAGP)", The Petroleum Society, Paper No. 97–137, pp 1–15, Jun. 8–11, 1997.

Jiang, Q., Butler, R.M., Yee, C.T., "The Steam and Gas Push (SAGP)–2: Mechanism Analysis and Physical Model Testing", The Petroleum Society, Paper No. 98–43, Jun. 8–10, 1998.

Jiang, Q., Butler, R.M., Yee, C.T., "Development of the Steam and Gas Push (SAGP) Process", GravDrain, Paper No. 1998.59, pp. 1–18, 1998.

Butler, R.M., Jiang, Q., Yee, C.T., "Steam and Gas Push (SAGP) –3; Recent Theoretical Developments and Laboratory Results", The Petroleum Society, Paper No. 99–23, Jun. 14–18, 1999.

Briggs, P.J., Beck, D.L., Black, C.J.J., Bissell, R., "Heavy Oil from Fractured Carbonate Reservoirs", Society of Petroleum Engineers, Inc., SPE No. 19671, May 1992.

Petit, H.J.–M., Renard, G., Valentin, E., "Technical and Economic Evaluation of Steam Injection with Horizontal Wells for Two Typical Heavy–Oil Reservoirs", Society of Petroleum Engineers, Inc., SPE No. 19828, pp 619–629, Oct. 8–11, 1989.

Mokrys, I.J., Butler, R.M., "In–Situ Upgrading of Heavy Oils and Bitumen by Propane Deasphalting: The Vapex Process", Society of Petroleum Engineers, Inc., SPE No., 25452, pp 409–424, Mar. 21–23, 1993, pp. 409–424.

Richardson, W.C., Chu, C., "Composition of Remaining Oil in a Mature Steamflood", Society of Petroleum Engineers, Inc., SPE No. 27796, pp. 137–151, Apr. 17–20, 1994.

Donnelly, J.K., Chmilar M.J., "The Commercial Potential of Steam Assisted Gravity Drainage", Society of Petroleum Engineers, Inc., SPE No. 30278, pp 295–308, Jun. 19–21, 1995.

Butler, R.M., Mokrys, I.J., Das, S.K., "The Solvent Requirements for Vapex Recovery", Society of Petroleum Engineers, Inc., SPE No. 30293, pp 465–474, Jun. 19–21, 1995.

Palmgren, C., Edmunds, N., "High Temperature Naptha to Replace Steam in the SAGD Process", Society of Petroleum Engineers, Inc., SPE No. 30294, pp 475–478, Jun. 19–21, 1995.

Das, S.K., Butler, R.M., "Countercurrent Extraction of Heavy Oil and Bitumen", Society of Petroleum Engineers, Inc., SPE No. 37094, pp 501–510, Nov. 18–20, 1996.

Singhal, A.K., Das, S.K., Leggitt, S.M., Kasraie, M., Ito, Y., "Screening of Reservoirs for Exploitation by Application of Steam Assisted Gravity Drainage/Vapex Processes", Society of Petroleum Engineers, Inc., SPE No. 37144, pp 867–876, Nov. 18–20, 1996.

Jiang, Q., Butler, R.M., "Selection of Well Configuration in Vapex Process", Society of Petroleum Engineers, Inc., SPE No. 37145, pp 877–885, Nov. 18–20, 1996.

Escobar, M.A., Valera, C.A., Perez, R.E., "A Large Heavy Oil Reservoir in Lake Maracaibo Basin: Cyclic Steam Injection Experiences", Society of Petroleum Engineers, Inc., SPE No. 37551, pp 347–447, Feb. 10–12, 1997.

Davies, D.K., Mondragon, J.J., Hara, P.S., "A Novel, Low Cost Well Completion Technique Using Steam for Formations with Unconsolidated Sands, Wilmington Field, California", Society of Petroleum Engineers, Inc., SPE Paper No. 38793, pp. 433–447, Oct. 5–8, 1997.

Das, S. K., "Vapex: An Efficient Process for the Recovery of Heavy Oil and Bitumen", Society of Petroleum Engineers, Inc., SPE Paper No. 50941, pp 232–237, Feb. 10–12, 1997.

Yuan, J.Y., Tremblay, B., Babchin, A., "A Wormhole Network Model of Cold Production in Heavy Oil", Society of Petroleum Engineers, Inc., SPE Paper No. 54097, pp 1–7, Mar. 17–19, 1999.

Escobar, E., Valco, P., Lee, W.J., Rodriguez, M.G., "Optimization Methodology for Cyclic Steam Injection with Horizontal Wells", Petroleum Society—Canadian Institute of Mining, Metallurgy & Petroleum, Paper No. CIM 65525, pp 1–12, Nov. 6–8, 2000.

Nghiem, L.X., Sammon P.H., Kohse, B.F., "Modeling Asphaltene Precipitation and Dispersive Mixing in the Vapex Process", Society of Petroleum Engineers, Inc., SPE Paper No. 66361, pp 1–11, Feb. 11–14, 2001.

Stone, T.W., Bennett, J., Holmes, J.A., "Thermal Simulation with Multisegment Wells", Society of Petroleum Engineers, Inc., SPE Paper No. 66373, pp 1–13, Feb. 11–14, 2001.

Lim, G.B., Kry, R.P., Harker, B.C., Jha, K.N., "Cyclic Stimulation of Cold Lake Oil Sand with Supercritical Ethane", Society of Petroleum Engineers, Inc., SPE Paper No. 30298, pp 521–528, Jun. 19–21, 1995.

Lim, G.B., Kry, R.P., Harker, B.C., Jha, K.N., "Three Dimensional Scaled Physical Modeling of Solvent Vapour Extraction of Cold Lake Bitumen", Canadian SPE/CIM/CANMET Paper No. HWC94–46, Mar. 20–23, 1994.

Batycky, J., "An Assessment of In situ Oil Sands Recovery Processes", The Journal of Canadian Petroleum Technology, vol. 36, No. 9, pp. 15–19, Oct. 1997.

* cited by examiner

COMBINED STEAM AND VAPOR EXTRACTION PROCESS (SAVEX) FOR IN SITU BITUMEN AND HEAVY OIL PRODUCTION

BACKGROUND OF THE INVENTION

This invention relates to a combined steam and vapour extraction process (SAVEX) for in situ bitumen and heavy oil production.

The Steam Assisted Gravity Drainage (SAGD) process is currently being applied in a range of reservoirs containing highly viscous bitumen in Athabasca to heavy oil in Lloydminster (both in Canada). The theoretical and design concepts required to make this recovery process successful have been published and extensively discussed in the technical and related industry literature. A major component of the capital and operating costs associated with the implementation of any future commercial SAGD projects will be the facilities required to: generate steam, separate produced hydrocarbons from associated condensed steam, and treat produced water to provide boiler feed. The volume of water that must be handled in such SAGD operations is reflected in the predicted steam oil ratios of 2 to 3 for active or anticipated projects. Any new technology or invention that reduces the cumulative steam to oil ratio of SAGD projects and introduces a significant improvement in thermal efficiency has the potential to dramatically improve in situ development economics.

A more recent in situ process has emerged for the recovery of bitumen or heavy oil. The vapor extraction process (VAPEX) which is solvent based is being proposed as a more environmentally friendly and commercially viable alternative to SAGD. The VAPEX process is comparable to the SAGD process as horizontal well pairs with the same configuration can be deployed in both instances. Also, both processes exploit a reduction in the viscosity of the in situ hydrocarbons. This combines with the influence of gravity to achieve well bore inflow and bitumen or oil production. The bitumen or oil is produced from a horizontal production well placed as close as practical to the bottom of the reservoir. Steam or vaporized solvent is injected into the reservoir through a horizontal injection well placed some distance above the producer. The facility related capital requirements for the VAPEX process are very much less than those necessary for SAGD in that the process requires minimal steam generation and associated water treating capacity.

There are risks associated with the VAPEX process technology when applied in the field. They include a protracted start up phase with reduced bitumen or oil rates and lower ultimate recovery. The operating procedure for this process presents limited opportunity for direct measurement of performance variables that can be used to optimize reservoir conformance. This contributes to the referenced risks.

Canadian Patent 1,059,432 (Nenninger) concerns reducing the viscosity of heavy hydrocarbons in oil sand with a pressurized solvent gas such as ethane or carbon dioxide at a temperature not substantially above ambient and below its critical temperature at a pressure of between 95% of its saturation pressure and not much more than its saturation pressure.

U.S. Pat. No. 4,519,454 (McMillen) provides a method for recovering heavy crude oil from an underground reservoir penetrated by a well which comprises heating the reservoir surrounding the well with steam at a temperature below coking temperature but sufficient to increase the temperature by 40–200° F. (22–111° C.) and then producing oil from the reservoir immediately after heating, without a soak period, until steam is produced and then injecting a liquid solvent having a ratio of crude viscosity to solvent viscosity of at least 10 and in an amount of from about 5–25 barrels per foot of oil-bearing formation and producing a solvent-crude mixture. This is essentially a thermal-solvent cycling system alternating between a thermal phase and a solvent phase as required.

Butler, R. M. and Mokrys. I. J. in J. Can. Petroleum Tech. 30(1) 97 (1991) discloses the VAPEX process for recovering heavy oil using hot water and hydrocarbon vapor near its dew point in an experimental Hele-Shaw cell. This process is useful in thin deposits in which heat losses to the overburden and underburden are excessive in thermal recovery processes. A solvent, such as propane, is used in a vapour-filled chamber. The resulting solution drains under gravity to a horizontal production well low in the formation. Solvent vapour is injected simultaneously with hot water to raise the reservoir temperature by 4–80° C. Diluted bitumen interacts with the hot water to redistil some of the vapour (e.g. propane) for further use. This also redistributes heat through the reservoir.

Butler, R. M. and Mokrys, I. J. in J. Can. Petroleum Techn. 32(6) 56 (1993) discuss and disclose further details of the VAPEX process using a large, sealed physical model.

Das, S. K. and Butler, R. M. in J. Can. Petroleum Tech. 33(6) 39 (1994) discuss the effect of asphaltene on the VAPEX process. A concern in use of the VAPEX process is possible plugging of the reservoir by deposited asphaltenes affecting the flow of diluted oil. This reference indicates that this is not necessarily a problem.

Das, K. K. in his Ph.D. dissertation of the University of Calgary (March 1995) on pages 129, 132–133 and 219–220 discusses VAPEX production rates from crudes of different viscosities. While the actual performance of the VAPEX process on crudes of higher viscosity is lower, the relative performance is better.

Palmgren, C. et al at the International Heavy Oil Symposium at Calgary, Alberta (1995) (SPE 30294) discusses the possible use of high temperature naphtha to replace steam in the SAGD process, i.e. naphtha assisted gravity drainage (NAGD). Naphtha recovery at the end is necessary for NAGD to compete with SAGD.

U.S. Pat. No. 5,899,274 (Frauenfeld et al) discloses a solvent-assisted method for mobilizing viscous heavy oil. The process comprises mixing at least two solvents, each soluble in oil, to form a substantially gaseous solvent mixture having a dew point that substantially corresponds with reservoir temperature and pressure, is a mix of liquid and vapour (but predominantly vapour) under such temperature and pressure and injecting the substantially gaseous solvent mixture into the reservoir to mobilize and recover reservoir-contained oil. This process reduces the need to manipulate reservoir temperature and pressure (a requirement of the VAPEX process). The solvent mix is chosen to suit the reservoir conditions rather than the other way round.

U.S. Pat. No. 5,607,016 (Butler) concerns a process and apparatus for recovery of hydrocarbons from a hydrocarbon (oil) reservoir. The process employs a non-condensible displacement gas along with a hydrocarbon solvent at a sufficient pressure to limit water ingress into the recovery zone. It appears to be a variant of the VAPEX process.

Butler, R. M. in Thermal Recovery of Oil and Bitumen, Grav-Drain Inc., Calgary, Alberta (1997) p. 292, 300 and 301 discusses calculated drainage rates for field conditions in the SAGD process.

Komery, D. P. et al, Seventh UNITAL International Conference, Beijing, China 1998 (No 1998.214) discuss pilot testing of post-steam bitumen recovery from mature SAGD wells in Canada with comments on the economics of the process.

Das, S. K. and Butler, R. M. in J. Petroleum Sci. Eng. 21 43 (1998) discuss the mechanism of the vapour extraction process for heavy oil and bitumen.

Saltuklaroglu, M. et al in CSPG and Petroleum Society Joint Convention in Calgary, Canada (1999), paper 99–25, discuss Mobil's SAGD experience at Celtic, Saskatchewan using single well and dual well systems. Donnelly, J. K. in the same joint Convention paper 99–26, compared SAGD with Cyclic Steam Stimulation (CSS).

Luhning, R. W. et al at the CHOA Conference at Calgary, Canada (1999) discuss the economics of the VAPEX process.

Butler, R. M. et al in J. Can Petroleum Tech. 39(1) 18 (2000) discuss the methodology for calculating a variety of parameters related to SAGD and disclose the development of a computer program, RISEWELL, to perform such calculations.

Butler, R. M. and Jiang, Q. in J. Can. Petroleum Techn. 39(1) 48 (2000) discuss ways of fine-tuning the VAPEX process for field use.

SUMMARY OF THE INVENTION

The invention provides a process for recovery of hydrocarbons from an underground reservoir of said hydrocarbons, the underground reservoir being penetrated by an injection well and a production well spaced from the injection well, the process comprising:

(a) injecting steam into said reservoir thereby heating said reservoir to mobilize and recover at least a fraction of reservoir hydrocarbons and to form a steam chamber in said reservoir; and then, (b) continuing to inject steam into said reservoir and mobilize and recover reservoir hydrocarbons therefrom until at least one of (i) an upper surface of said chamber has progressed vertically to a position that is approximately 25 to 75%, preferably 40 to 60%, or about 50% the distance from the bottom of the injection well to the top of the reservoir, and (ii) the recovery rate of said hydrocarbons is approximately 25 to 75%, preferably 40 to 60%, or about 50% of the peak predicted recovery rate using steam-assisted gravity drainage; and (c) injecting into the reservoir a viscosity reducing solvent of at least an additional fraction of reservoir hydrocarbons, said solvent being capable of existing in vapor form in said chamber and being just below said solvent's saturation pressure in said chamber thereby mobilizing and recovering an additional fraction of hydrocarbons from said reservoir.

Depending upon the particular circumstances there may or may not be a phase in which both steps (b) and (c) are practised simultaneously. This phase may be transitional before step (b) is stopped and the process continues with step (c) alone.

Preferred solvents include $C_1$ to $C_8$ normal hydrocarbons, i.e. methane, ethane, propane, butane, pentane, hexane, heptane and octane especially ethane or propane, or a mixture thereof.

Additionally a displacement gas may be employed in step (c) before, during or after injection of the solvent. A displacement gas is a gas that is non-condensible at reservoir temperature and pressure conditions. Examples include nitrogen, natural gas, methane and carbon dioxide. Methane can act as a solvent or as a displacement gas depending upon the particular prevailing conditions.

A preferred and useful feature of this invention is recovery of volumes of viscosity reducing solvent from the reservoir after cessation of injection, for example during a "blow down" by continuing production and dropping the pressure in the reservoir. The recovered viscosity reducing solvent can be employed in adjacent active wells.

This invention can be distinguished from steam start-up processes in that steam is used not just as a start-up but until a chamber has been formed in the reservoir that is of sufficient size to allow the solvent stage to take over without the need to alternate between steam and solvent stages to effect recovery.

The injection well and the production well are both laterally extending, preferably substantially horizontally. The production well can run parallel to and below the injection well.

BRIEF DESCRIPTION OF THE DRAWINGS

FIG. 2(*b*) is an end view of FIG. 2(*a*).

FIG. 3(*b*) is an end view of FIG. 3(*b*).

DETAILED DESCRIPTION

Figure 1:
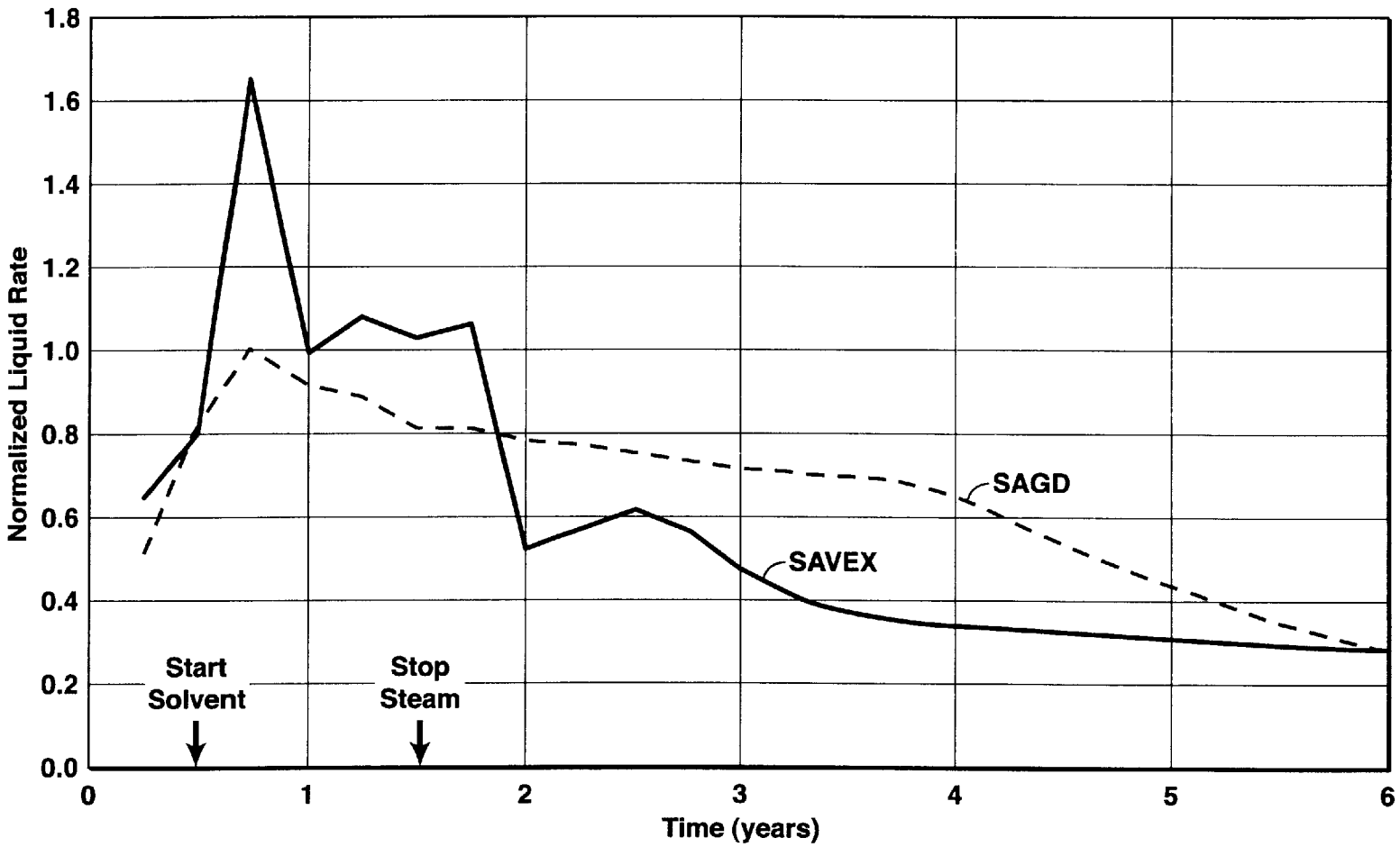
FIG. 1 graphs results from a field scale computer simulation comprising results of the process of the invention (SAVEX) with those of the prior art SAGD process normalized to the maximum producing rate observed for SAGD.

The invention involves the combination of the integral elements of the SAGD process with the integral elements of the VAPEX process to create the combined steam and vapor extraction process (SAVEX). This invention delivers ultimate bitumen or oil recovery levels that equate to the predictions for either the SAGD or VAPEX process but with a more favourable economic return. The improved rate of return for the SAVEX process relative to either SAGD or VAPEX is attributed to the higher SAGD equivalent bitumen or oil production rates during the process start up. In addition, the bitumen or oil production rates are enhanced during the VAPEX phase when the stored energy in the reservoir which originates from the prior steam injection supplements the viscosity reduction caused by the diffusion of the solvent into the bitumen or heavy oil. In addition, no heat is lost to the overburden which is a significant factor in SAGD thermal efficiency. This innovative combined process called SAVEX also captures the benefits of lower energy consumption, less environmental pollution, in situ ungrading, and lower capital costs.

A predicted SAGD unit drainage rate for an Athabasca horizontal well pair is 0.28 $m^3$/d per m (Butler text, page 301, 1997) which equates to 140 $m^3$/d for a 500 m long well pair. (h=20 m, $K_{eff}$=1 darcy, So=0.825, Sor=0.175, steam T=230° C., and porosity=0.325). Extensive experimentation with Hele-Shaw cells and later packaged porous media models provided an initial basis for predicting production rates for the VAPEX process. A per unit rate of 0.023 $m^3$/d per day (Das thesis, page 220, 1995) for butane extraction of Peace River bitumen would be depreciated 20% (Das thesis, Table 8.5, page 132, 1995) for equivalence with Athabasca bitumen, appreciated 15% with the use of a more favourable solvent such as propane and the positive influence of higher temperatures (Butler and Jiang, op. cit. FIG. 10, page 53), and further appreciated 50% (Das & Butler, page 42, 1994) to account for the flow enhancement attributed to in situ asphaltene, deposition and the associated reduction in viscosity. The resultant predicted field production rate for a VAPEX process in a reservoir with the same properties as described above for a 500 m well but a $K_{eff}$ of 5 darcy would be 16 $m^3$/d. The most recent work with numerical models, which have been calibrated, with physical model experiments and scaled up to field dimensions suggests production rates which are 50% of the SAGD rates are possible with the solvent extraction VAPEX process.

One of the key elements of the invention is the design of an operating procedure that achieves the transition from the SAGD phase to the VAPEX phase to realize the bitumen or heavy oil recovery with an enhanced or higher production rate profile. The objectives of the SAGD phase are:

(i) to establish communication between the producer and injector over the entire length of the horizontal wells.

(ii) to create a vapor chamber near the injector to ensure that the initial asphaltene precipitation occurs some distance away from the well bores.

(iii) to ensure that the vapor chamber is large enough to sustain the required solvent induced drainage rates.

Figure 2A:
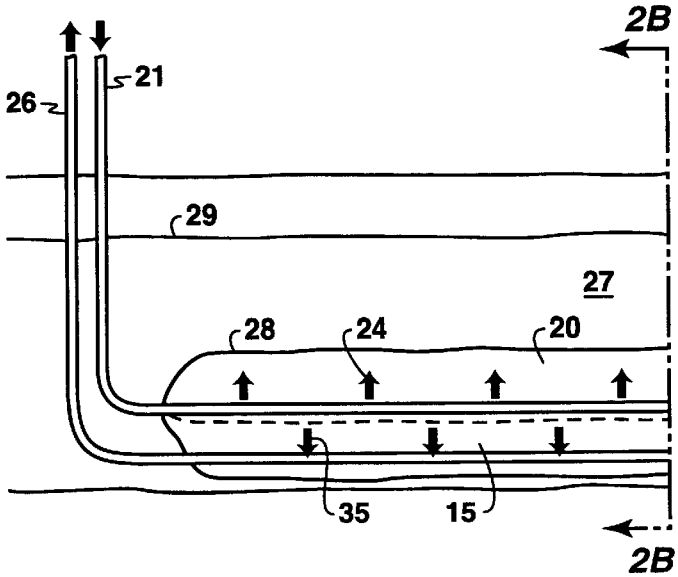
FIG. 2(*a*) is a side view of a claimed embodiment of the process at the end of the steam injection interval.
Figure 2B:
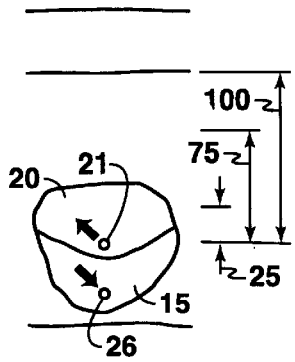

In one embodiment a process for recovery of hydrocarbons from an underground reservoir of said hydrocarbons is disclosed. As shown in FIG. 2(*a*) The underground reservoir 27 is penetrated by an injection well 21 and a production well 26 spaced from the injection well. FIG. 2(*b*) is a side view representation of FIG. 2(*a*) wherein similar elements are given the same reference numbers. The process comprises three steps.

Figure 3A:
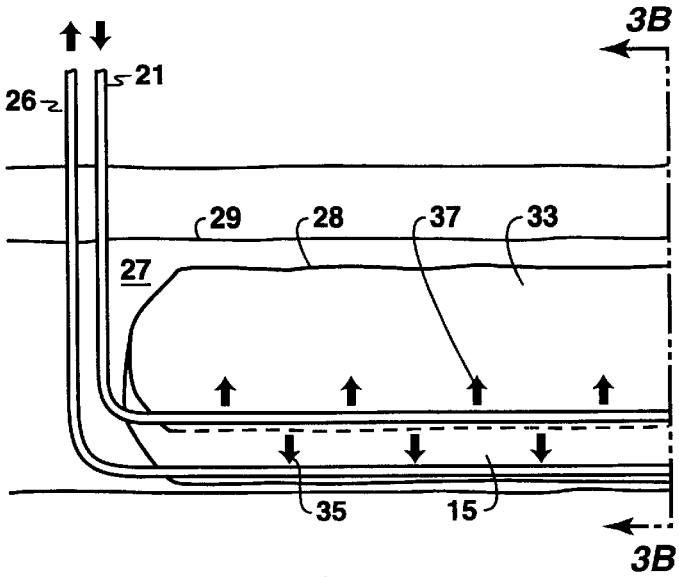
FIG. 3(*a*) is a side view of a claimed embodiment of the process during the solvent injection interval.
Figure 3B:
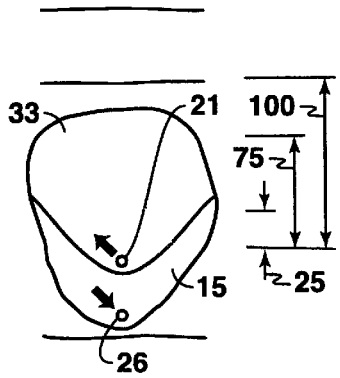

First, steam is injected into the reservoir 27 thereby heating the reservoir to mobilize and recover at least a fraction of reservoir hydrocarbons and to form a steam chamber 20 in the reservoir. Second, steam is continuously injected into the reservoir to mobilize and recover reservoir hydrocarbons therefrom until at least one of (i) an upper surface of the chamber 28 has progressed vertically 24 to a position that is approximately 25 percent (25) to 75 percent (75) the distance 100 from the bottom of the injection well 26 to the top 29 of the reservoir 27, and (ii) the recovery rate of the hydrocarbons 35 is approximately 25 percent to 75 percent of the peak predicted recovery rate using steam-assisted gravity drainage. Finally, as shown in FIG. 3(*a*) a viscosity-reducing hydrocarbon solvent is injected into the reservoir 27, the solvent being capable of existing in vapor form in the chamber 33 and being just below the solvent's saturation pressure in the chamber 33, thereby mobilizing and recovering an additional fraction of hydrocarbons 15 from the reservoir 27. FIG. 3(*b*) is a side view representation of FIG. 3(*a*) For FIGS. 2(*a*), 2(*b*), 3(*a*) and 3(*c*) similar elements are given the same reference numbers.

To accomplish this transition, as shown in FIGS. 2(*a*) and 2(*b*), steam injection into the injection well 21 is suspended and replaced with solvent injection at a specified point in time. This specified transition time will occur when it is estimated that the SAGD steam chamber 20 has progressed vertically to a position that is approximately 25 (25) to 75% (75), preferably 40 (not shown) to 60% (not shown), or about 50% (50) the distance 100 from the steam injection well 21 to the top 29 of the reservoir 27. Published performance data from active SAGD operations suggest that this will typically occur when the production rates have reached or exceed approximately 25 to 75%, preferably 40 to 60%, or about 50% of the predicted maximum rates that would have been reached with continuation of the SAGD process and the upward progression of the steam chamber to the top of the reservoir. Vertically drilled observation wells equipped with temperature recording devices provide the ability to measure and record the location of the top of the steam chamber in existing SAGD operations. Available computer simulation capability provides a method of predicting both steam chamber dimensions and producing rates for the SAGD recovery process.

For a typical SAGD well pair in Athabasca this cross over in injection from steam to vaporized solvent should occur about 4 to 6 months after the initiation of SAGD operations. An alternative cross over strategy from the SAGD to VAPEX processes is also contemplated. This involves an interval of continued steam injection with addition of the solvent scheduled for the VAPEX phase. The transition phase as described sustains the SAGD production rates and begins to develop the higher solvent concentrations in the bitumen or heavy oil that are required for its continued mobilization and subsequent production. The selection of the solvent and adjustments to the operating pressure in the SAGD steam chamber, which is inherited from the SAGD phase of the process' operation, must meet certain criteria. As shown in FIGS. 3(*a*) and 3(*b*), first, the solvent must exist in vapor form in the reservoir 27 within the VAPEX chamber 33 and be just below the respective solvent's saturation pressure. This means that initially the VAPEX chamber 33 pressure can be elevated and consistent with a higher flowing bottom hole pressure. This will mitigate the need for artificial lift when the produced fluids are hot. The higher SAGD chamber temperatures will increase the bitumen or heavy oil production rates and improve the economic return of the process. The flow 35 of bitumen or heavy oil 15 into the production well during the VAPEX phase of the recovery process decreases and converges to the stand alone rate for a VAPEX process with no thermal up lift.

This convergence to the lower rate is delayed by the influence of the heat that is scavenged from the SAGD steam chamber and transported to the bitumen or heavy oil that is encountered by the solvent at the interface between the expanding 37 VAPEX chamber 33 and the native reservoir 27. This thermal effect supplements the viscosity reduction caused by the mixing of the solvent and bitumen or heavy oil 15 and increases the hydrocarbon producing rates 35. During the VAPEX phase of the operation the pressure in the VAPEX chamber is reduced and appropriate artificial lift will be required to lift the fluids to the surface. An operating control system is employed to ensure production rates are maximized while also ensuring that free solvent reproduction is limited and that a liquid level is maintained above the elevation of the profile of the lower horizontal or producing well. The elevation in hydrocarbon producing rate during both the SAGD as well as the VAPEX and any transition phases of the producing life of this novel reservoir recovery process relative to a stand-alone conventional VAPEX process is the invention's economic driver. Combining this increase in the real value of the revenue stream with the reduced capital requirements for surface facilities and reduction in operating costs after conversion creates a process that has a competitive advantage over established commercial technology.

The result from a representative field scale computer simulation of a typical operating scenario for the SAVEX process is shown in FIG. 1. In the example the switch-over from SAGD and the transition to VAPEX occurred 0.5 years after start-up. The displayed producing rates are normalized to the maximum producing rate for the referenced SAGD-only case.

Novelties and advantages of the invention include:

Utilization of one well bore geometry and associated tubular configuration design to deploy two different reservoir recovery processes with an optimized operating sequence that is unique for each reservoir. This captures the best of both processes: a rapid start up, low bitumen or oil saturation in the near well bore region when the solvents are introduced, and low heat loss to the over burden later in the process.

Rationalized surface facilities that provide energy input (steam), process produced fluids, recycle produced solvent, and treat produced water for a multi-well pair development at a reduced capital and operating cost compared to a conventional SAGD project.

The transition from an immature SAGD steam chamber into the expanding vaporized solvent chamber of the VAPEX process.

Utilization of well bore thermocouple data including those obtained during a specified shut in interval to dimension steam chamber distribution and provide a basis for influencing the injection of the solvent in order to maximize the volume of reservoir that is depleted by gravity drainage.

What is claimed is:

1. A process for recovery of hydrocarbons from an underground reservoir of said hydrocarbons, the underground reservoir being penetrated by an injection well and a production well spaced from the injection well, the process comprising:

(a) injecting steam into said reservoir thereby heating said reservoir to mobilize and recover at least a fraction of reservoir hydrocarbons and to form a steam chamber in said reservoir; and then, (b) continuing to inject steam into said reservoir and mobilize and recover reservoir hydrocarbons therefrom until at least one of (i) an upper surface of said chamber has progressed vertically to a position that is approximately 25 percent to 75 percent the distance from the bottom of the injection well to the top of the reservoir, and (ii) the recovery rate of said hydrocarbons is approximately 25 percent to 75 percent of the peak predicted recovery rate using steam-assisted gravity drainage; and (c) injecting into the reservoir a viscosity-reducing hydrocarbon solvent, said solvent being capable of existing in vapor from in said chamber and being just below said solvent's saturation pressure in said chamber, thereby mobilizing and recovering an additional fraction of hydrocarbons from the reservoir.

2. A process according to claim 1 wherein the upper surface of the steam chamber has progressed vertically to a position that is about 40 percent to 60 percent of the distance from the bottom of the injection well to the top of the reservoir.

3. A process according claim 1 wherein the surface of the steam chamber has progressed vertically to a position that is about 50 percent of the distance from the bottom of the injection well to the top of the reservoir.

4. A process according to claim 1 wherein the recovery rate of the hydrocarbons is about 40 percent to 60 percent of the peak predicted recovery rate.

5. A process according to claim 1 wherein the recovery rate of the hydrocarbons is about 50 percent of the peak predicted recovery rate.

6. A process according to claim 1 wherein the injection well and the production well are both substantially horizontal.

7. A process according to claim 1 wherein the production well is substantially parallel to and below the injection well.

8. A process according to claim 1 wherein there is a phase in which both steps (b) and (c) are practised simultaneously.

9. A process according to claim 1 wherein there is a phase in which both steps (b) and (c) are practiced simultaneously, followed by a phase wherein step (c) is continued without steam injection.

10. A process according to claim 1 wherein the viscosity-reducing hydrocarbon solvent is selected from the group consisting of ethane, propane, and mixture thereof.

11. A process according to claim 1 additionally comprising injecting a displacement gas in step (c).

12. A process according claim 1 wherein the displacement gas is selected from the group consisting of nitrogen, carbon dioxide, and mixtures thereof.

13. A process according to claim 1 additionally comprising recovering said viscosity-reducing hydrocarbon solvent from said additional fraction of hydrocarbons recovered from said reservoir.

14. A process according to claim 1 additionally comprising recovering and recycling said viscosity-reducing hydrocarbon solvent from said additional fraction of hydrocarbon recovered from said reservoir.

15. A process according to claim 1 wherein a fraction of the recovered reservoir hydrocarbon is utilized as the viscosity-reducing hydrocarbon solvent.

16. A process according claim 1 additionally comprising cessation of injection and continued production to recover volumes of said viscosity-reducing hydrocarbon solvent from the reservoir.

17. A process for recovery of hydrocarbons from an underground reservoir of said hydrocarbon, the underground reservoir being penetrated by an injection well and a production well spaced from the injection well, the process comprising:

(a) injecting steam into said reservoir thereby heating said reservoir to mobilize and recover at least a fraction of reservoir hydrocarbons and to form a steam chamber in said reservoir; and then, (b) continuing to inject steam into said reservoir and mobilize and recover reservoir hydrocarbons therefrom until an upper surface of said chamber has progressed vertically to a position that is at least approximately 25 percent to 75 percent the distance from the bottom of injection well to the top of the reservoir; and then, (c) injecting into the reservoir a viscosity-reducing hydrocarbon solvent, said solvent being capable of existing in vapor form in said chamber and being just below said solvent's saturation pressure in said chamber, thereby mobilizing and recovering an additional fraction of hydrocarbons from the reservoir.

18. A process according to claim 17 wherein the upper surface of the steam chamber has progressed vertically to a position that is about 40 percent to 60 percent of the distance from the bottom of the injection well to the top of the reservoir.

19. A process according to claim 17 wherein the surface of the steam chamber has progressed vertically to a position that is about 50 percent of the distance from the bottom of the injection well to the top of the reservoir.

20. A process for recovery of hydrocarbons from an underground reservoir of said hydrocarbons, the underground reservoir being penetrated by an injection well and a production well spaced from the injection well, the process comprising:

(a) injecting steam into said reservoir thereby heating said reservoir to mobilize and recover at least a fraction of reservoir hydrocarbons and to form a steam chamber in said reservoir; and then, (b) continuing to inject steam into said reservoir and mobilize and recover reservoir hydrocarbons therefrom until the recovery rate of said hydrocarbons is at least approximately 25 percent to 75 percent of the peak predicted recovery rate using steam-assisted gravity drainage; and, then, (c) injecting into the reservoir a viscosity-reducing hydrocarbon solvent, said solvent being capable of existing in vapour form in said chamber and being just below said solvent's saturation pressure in said chamber, thereby mobilizing and recovering an additional fraction of said hydrocarbons from the reservoir.

21. A process according to claim 20 wherein the recovery rate of the hydrocarbons is about 40 percent to 60 percent of the peak predicted recovery rate.

22. A process according to claim 20 wherein the recovery rate of the hydrocarbons is about 50 percent of the peak predicted recovery rate.

23. A process according to claim 1 wherein said viscosity-reducing hydrocarbon solvent is selected from the group consisting of methane, ethane, propane, butane, pentane, hexane, heptane and octane and a mixture thereof.

* * * * *